United States Patent [19]

Bullock

[11] Patent Number: 4,676,172

[45] Date of Patent: Jun. 30, 1987

[54] FRAMELESS RADIAL TRUCK

[75] Inventor: Robert L. Bullock, Lombard, Ill.

[73] Assignee: Standard Research and Design Corp., Park Ridge, Ill.

[21] Appl. No.: 784,224

[22] Filed: Oct. 4, 1985

Related U.S. Application Data

[63] Continuation-in-part of Ser. No. 557,593, Dec. 2, 1983, abandoned.

[51] Int. Cl.[4] ..... B61F 5/38; B61F 5/30

[52] U.S. Cl. ..... 105/168; 105/176; 105/224.05; 105/224.1

[58] Field of Search ..... 105/157 R, 165, 167, 105/168, 176, 182 R, 199 R, 199 F, 199 S, 218 R, 224 R, 224.1, 182.1, 199.1, 199.5, 218.1, 224.05

[56] References Cited

U.S. PATENT DOCUMENTS

| | | | |
|---|---|---|---|
| 325,532 | 9/1885 | Graff | 105/165 |
| 383,164 | 5/1888 | Youmans | 105/165 |
| 402,950 | 5/1889 | Maloy | 105/169 |
| 490,598 | 1/1893 | Huston | 105/165 |
| 548,365 | 10/1895 | Heath | 105/165 |
| 555,857 | 3/1896 | Graham | 105/165 |
| 986,185 | 3/1911 | Lincoln | 105/165 |
| 1,003,277 | 9/1911 | Lincoln | 105/168 |
| 1,105,291 | 7/1914 | Munn | 105/168 |
| 1,493,682 | 5/1924 | Kruger | 105/165 |
| 1,707,046 | 3/1929 | Boyden | 105/165 |
| 2,782,729 | 2/1957 | Heredia | 105/168 X |
| 2,802,662 | 8/1957 | Hirst | 105/224.1 X |
| 2,876,646 | 3/1959 | Nickson | 74/42 |
| 2,953,994 | 9/1960 | Furrer | 105/157 R |
| 2,963,987 | 12/1960 | Cottrell | 105/224 R |
| 3,191,551 | 6/1965 | Hirst | 105/199 F X |
| 3,286,653 | 11/1966 | Weber | 105/165 |
| 3,394,662 | 7/1968 | Weber | 105/165 |
| 3,424,105 | 1/1969 | Cripe | 105/4 R |
| 3,528,374 | 9/1970 | Wickens | 105/182 R |
| 3,593,670 | 7/1971 | Aubert | 105/224.1 X |
| 3,638,582 | 2/1972 | Beebe | 105/218 R |
| 3,675,592 | 7/1972 | Bateson | 105/4 R X |
| 3,680,888 | 8/1972 | Hirst | 105/224.1 X |
| 3,682,102 | 8/1972 | Pocklington | 105/157 R |
| 3,777,672 | 12/1973 | Schneider | 105/224.1 X |
| 3,920,231 | 11/1975 | Harrison | 105/224.1 |
| 3,952,669 | 4/1976 | Mauzin | 105/171 |
| 3,952,670 | 4/1976 | Harrison | 105/224.1 |
| 4,067,261 | 1/1978 | Scheffel | 105/157 R |
| 4,067,262 | 1/1978 | Scheffel | 105/168 |
| 4,091,739 | 5/1978 | Theurer | 105/224 R |
| 4,109,586 | 8/1978 | Briggs | 105/224 A |
| 4,131,069 | 12/1978 | List | 105/168 |
| 4,134,343 | 1/1979 | Jackson | 105/167 |
| 4,150,626 | 4/1979 | McInerney | 105/199 F |
| 4,166,611 | 9/1979 | Geers | 105/224.1 X |
| 4,258,629 | 3/1981 | Jackson | 105/167 |
| 4,282,816 | 8/1981 | Harrison | 105/224.1 |
| 4,285,280 | 8/1981 | Smith | 105/168 |
| 4,294,175 | 10/1981 | Harsy | 105/199 R |
| 4,300,454 | 11/1981 | Scheffel | 105/168 |
| 4,356,775 | 11/1982 | Paton | 105/218 A |
| 4,480,553 | 11/1984 | Scheffel | 105/167 |
| 4,483,253 | 11/1984 | List | 105/167 |

FOREIGN PATENT DOCUMENTS

| | | |
|---|---|---|
| 833657 | 2/1952 | Fed. Rep. of Germany . |
| 833658 | 2/1952 | Fed. Rep. of Germany . |
| 1184372 | 12/1964 | Fed. Rep. of Germany . |
| 1780140 | 11/1972 | Fed. Rep. of Germany . |
| 1019626 | 1/1953 | France . |
| 1240914 | 7/1971 | United Kingdom . |

*Primary Examiner*—Randolph A. Reese
*Assistant Examiner*—David F. Hubbuch
*Attorney, Agent, or Firm*—Kinzer, Plyer, Dorn & McEachran

[57] ABSTRACT

A frameless self-steering radial wheeled support vehicle for a railroad car body includes:

(a) a pair of wheelsets, (b) a support at opposite ends of each wheelset for independently mounting a railroad car body on each end of the wheelset, (c) resilient shear pads for mounting each support upon an end of a wheelset, which pads permit both lateral and yaw movement of a wheelset relative to its supports, and (d) a linkage connecting adjacent ends of each wheelset constraining the wheelsets to yaw in opposite sense and permitting lateral movement of one wheelset relative to the other.

44 Claims, 6 Drawing Figures

FRAMELESS RADIAL TRUCK

SUMMARY OF THE INVENTION

This is a continuation-in-part of application Ser. No. 557,593, filed Dec. 2, 1983 now abandoned.

The present invention relates to frameless self-steering radial wheeled support vehicles, such as car trucks or bogies, which are used to support a railroad car body.

A primary purpose of the invention is a self-steering radial truck or bogey or wheeled vehicle of the type described which permits limited yaw and lateral movement of the wheelsets relative to each other.

Another purpose is to provide a large weight reduction in a self-steering radial truck or bogie or wheeled vehicle, when compared with trucks having conventional side frames and bolsters.

Another purpose is to provide a railroad car truck having good hunting stability for the wheelsets and car body at vehicle speeds substantially beyond normal railroad operating speeds.

Another purpose is a truck of the type described in which the conventional side frames and bolster have been eliminated and in which the car body is independently supported at each end of each wheelset.

Another purpose is a frameless self-steering radial wheeled vehicle which includes resilient pads or equivalent yielding resistance to relative movement which provides for both lateral and yaw movement of the wheelsets relative to the car body.

Another purpose is a wheeled vehicle of the type described in which there are separate and independent series resistances to relative lateral movement of the car body and wheelsets.

Another purpose is a wheeled railway support vehicle of the type described in which the car body is independently supported at opposite ends of each wheelset, which support includes springs and wedge-type dampers, with opposite ends of the wheelsets being connected together and constrained for relative yaw movement.

Another purpose is a frameless radial railway support vehicle of the type described which permits restrained lateral and yaw movement of the wheelsets and prevents relative longitudinal movement of the wheelsets.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The term "radial truck" has been used in the railroad industry to designate a railway support vehicle or truck or bogie which is essentially self-steering or which can follow the radius of curvature of most curves found in conventional railway usage. Heretofore, radial trucks have used as a foundation the conventional three-piece concept of two side frames and a bolster to form the frame for the truck and to form a means whereby the car body is supported on the truck.

The present invention is particularly concerned with a radial truck in which the bolster and side frames have been eliminated, with very substantial savings in weight for each railroad car. Specifically, by eliminating the bolster and side frames conventionally found in most railroad bogies, there is a reduction in weight of approximately 5,000 lbs per car. By eliminating the bolster and side frames, changes in the support structure of the car body can be made which will eliminate an additional 3,000 lbs. of weight per car. Accordingly, the frameless radial truck of the present invention can provide a railroad car weighing in the area of 8,000 lbs. less than previous cars suitable for the same traffic. This reduction in weight not only permits the car to carry a greater load, but also provides substantial fuel economies in running unloaded cars.

Elimination of the side frames and bolster, however, presents many design problems since these elements provide the means whereby the car body is supported on the truck and they provide the basic frame whereby the truck is self-steering and through which constraints are placed on the lateral and yaw movements of the wheelsets during self-steering. Specifically, the present invention provides a frameless radial self-steering support vehicle for a railroad car environment in which the bolster and side frames have been eliminated; in which the car body is independently supported on each end of each wheelset; in which there are resilient shear pads constraining both lateral and yaw movements of the wheelsets relative to the car body; and in which there is a connecting linkage between adjacent ends of each wheelset, which linkage constrains the wheelsets to yaw in opposite sense while permitting lateral movement of one wheelset relative to the other and which further contains the the wheelsets from net longitudinal movement with respect to each other.

Figure 1:
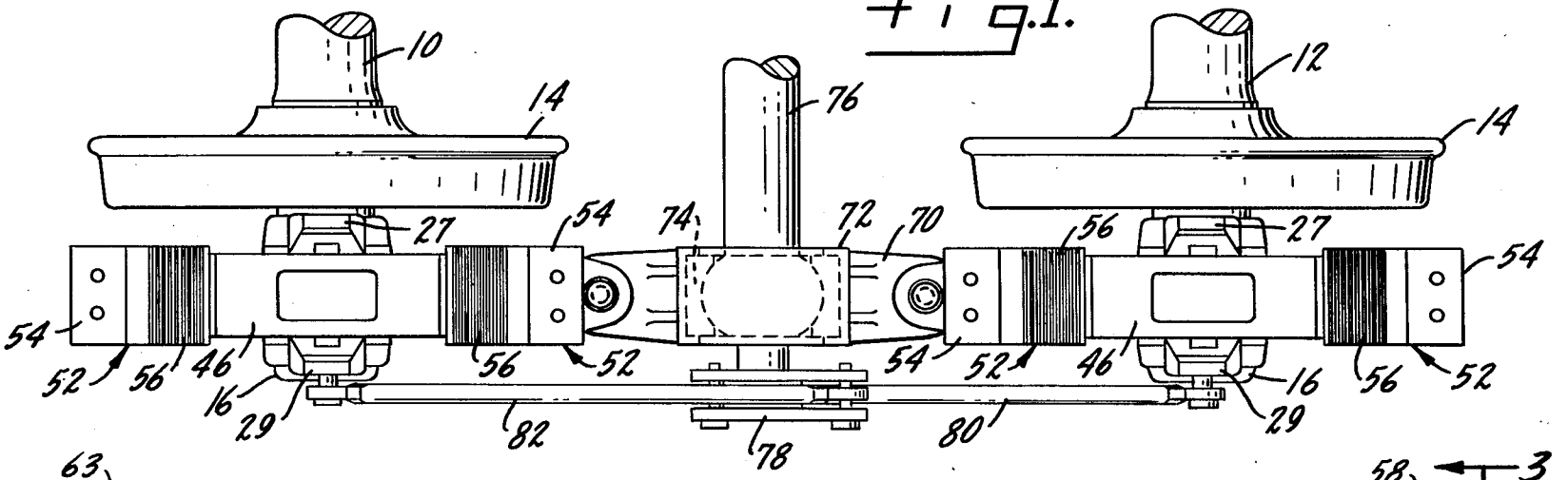
FIG. 1 is a partial top plan view of a railway vehicle of the type described.

A pair of spaced conventional wheelsets are indicated at 10 and 12, there being a wheel 14 attached on the illustrated end of each wheelset. It is understood that the top plan view of FIG. 1 only shows a portion of the truck and that the wheelsets will continue with identical structure, not shown, on the opposite side of each truck or vehicle. Wheels 14 may be of conventional conicity or may have a special profile. It is preferred to use a profile similar to that of a worn wheel which has a high effective conicity with approximately a 0.5 inch flange clearance with the rail and a high flange contact angle. Such a conicity has a profile quite similar to that of a naturally worn wheel.

Each of the wheelsets 10 and 12 will have a roller bearing 16 at each end of the wheelset and each roller bearing 16 will support a roller bearing adapter 18. Mounted upon each roller bearing adapter 18 is a plurality of resilient shear pads indicated generally at 20. There may be a single shear pad, although it is preferred that there be multiple or a plurality of shear pads, as illustrated. The pads will be of similar size and shape and will be separated by metal plates, as is conventional. Shear pads 20 should be formed of a material which will provide a predetermined amount of damping within the material of the pads of not less than ten percent of critical damping in order to provide adequate car body stability under loaded car conditions.

Figure 2:
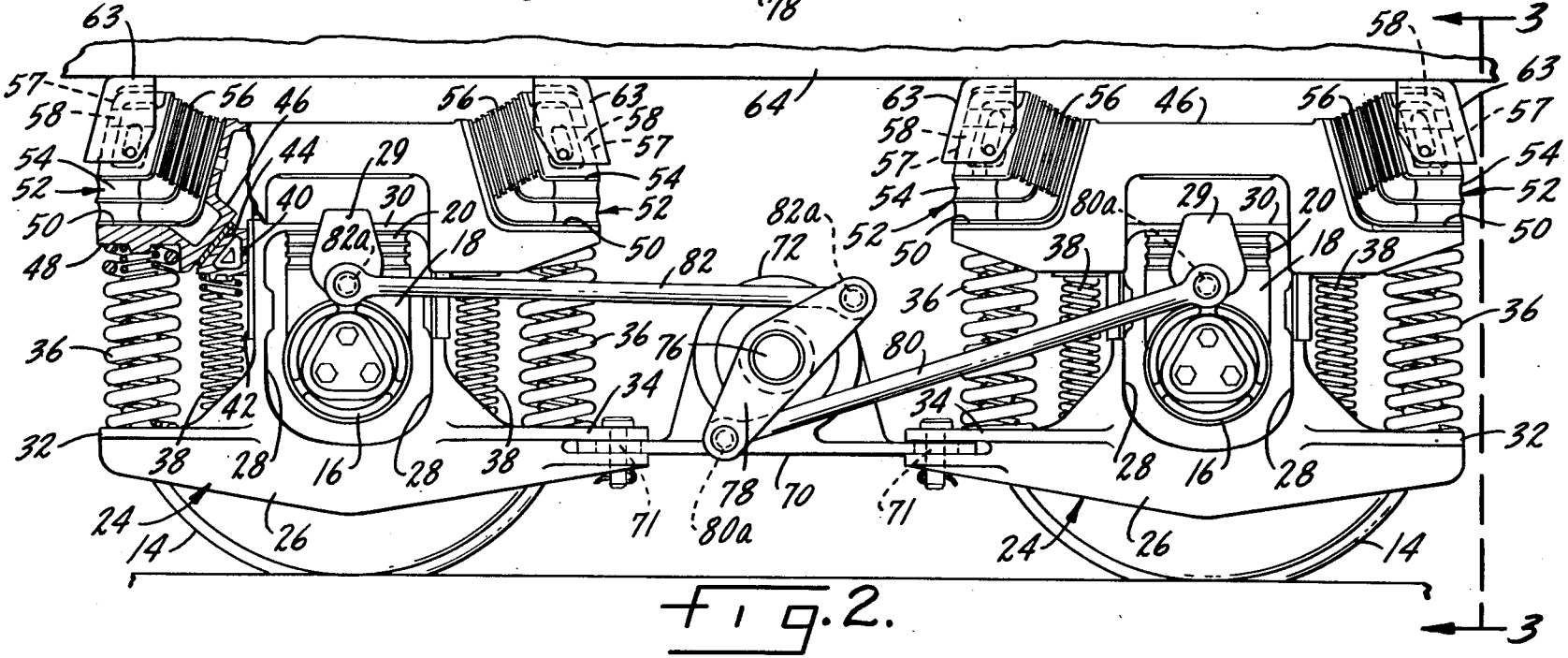
FIG. 2 is a side view of the railway vehicle disclosed herein.

The shear pads support a pedestal indicated generally at 24. Pedestal 24 has a bottom portion 26, upstanding side walls 28 and a top portion 30 which is seated upon shear pad 20. In effect, walls 28 and 30 form a small housing which not only is supported upon the shear pad, but restricts the amount of lateral and yaw movement between the wheelset and the pedestal. As particularly illustrated in FIG. 2, there are gaps between adapter 18 and housing walls 28. These gaps permit yaw movement of the wheel set in an amount equal to the longitudinal clearance which, in the preferred embodiment, may be on the order of one and one-quarter inch. Adapter 18 has upstanding inboard and outboard ears 27 and 29 respectively which cooperate with top wall portion 30 to permit a similar amount of lateral movement of the wheelset relative to the pedestal. This amount of movement may be on the order of an inch in each lateral direction. Thus, when considering the relationship between the wheelset, its roller bearing adapters, the supporting resilient shear pads 20 and the pedestals 24 which are mounted upon the wheelset by the shear pads, the wheelsets have a permitted yaw and lateral displacement relative to the pedestals or the support structure.

Each pedestal includes, as a part of bottom member 26, an outside platform 32 at one side of the bottom member and an inside platform 34 at the opposite side. Each of the platforms 32 and 34 mount springs 36 which are similar to conventional load bearing or load carrying springs normally found between the side frame and bolster of a car truck. Springs 36 support the weight of the car body on the pedestal and thus the wheelsets. In addition to springs 36, there are smaller damping springs 38 supported on the platforms, which damping springs 38 each support a friction wedge or damping member 40. Wedges 40 bear against wear plates 42 mounted on the outside of walls 28, much in the manner of a conventional three-piece truck. The wedges or friction members fit within pockets 44 formed in a wheelset frame member 46 which extends over the top of the roller bearing adapter, shear pads and pedestal top member 30 and have downwardly facing seat areas 48 at opposite sides thereof which form the upper seat for springs 36. Thus, wheelset frame members 46 are supported on springs 36 and in turn will support the car body, as described. There is only a small, about one-eighth inch, lateral clearance between frame member 46 and side walls 28 and the side flanges of the frame member are in contact with plate 42.

Figure 3:
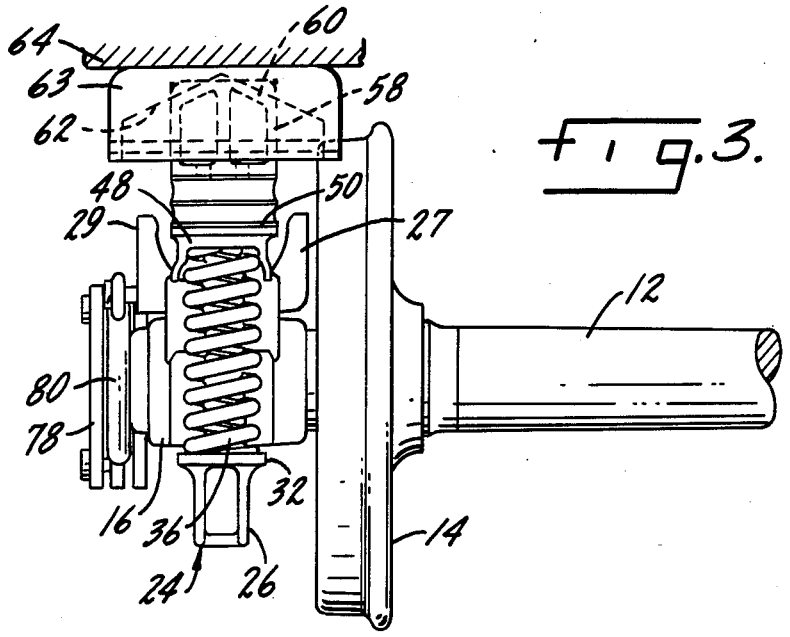
FIG. 3 is a partial section taken along plane 3—3 of FIG. 2.

Formed at opposite sides of each wheelset frame member 46 is an upper platform 50 which has a generally horizontal portion and an upwardly slanted portion. Positioned on each platform 50 is a resilient shear pad construction 52, which again may be a single shear pad or a plurality of shear pads, although the latter is preferred. Shear pad constructions 52 each include shear pads with a horizontal portion 54 and an upwardly directed or slanted portion 56. The shear pads fit within the contour defined by platforms 50 and support on the upper ends thereof a friction member or wedge 58, specifically illustrated in FIGS. 2 and 3.

Wedge members 58, which may be formed of the same metallurgical composition as friction wedges 40, seat upon the shear pads as described and have an upper wedge-shaped nose 60 which extends within a similar wedge-shaped pocket 62 of a wedge cover 63 which is attached to car body 64. Wedges 58, there being two such wedges at each end of each wheelset, independently support the car body upon the wheelsets. The car body wedge covers 63 maintain the wedges in position within the pockets and resting upon the shear pad construction. Each of the wedge members 58 has a slope on the opposite surface from that in contact with the upward slanted portion 56 of the shear pad. The sloping surface, indicated at 57, has approximately the same direction or is generally parallel to the slanted surface of shear pad portion 56. Sloping or slanted surfaces 57 further have a crown or slight radius in the slanted direction as will be explained in detail hereinafter.

Figure 2A:
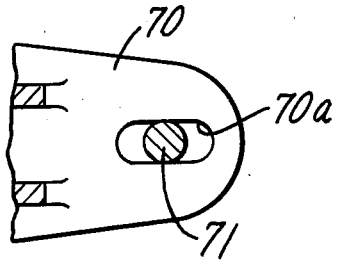
FIG. 2*a* is an enlarged partial top plan view of a portion of the connection between adjacent wheelsets.

Adjacent ends of wheelsets 10 and 12 are pivotally connected together. Pedestals 24, specifically the inboard platforms thereof, indicated at 34, each pivotally support a bearing housing or platform member 70 which includes a bearing member 72 having an internal pillow block 74. The pivotal connection, shown in detail in FIG. 2*a*, which includes a slot 70*a* formed in each end of bearing housing 70 and a pin 71, preferably allows for lateral deflection of the pedestal of one wheelset with respect to the other by permitting rotational and longitudinal movement between the pedestals and the associated bearing housing. Pillow blocks 74, at opposite sides of the bogie, support a torque rod or tube 76 extending from one side of the vehicle to the other. Positioned on the outboard ends of torque rod 76 at each end thereof is a clevis 78, particularly illustrated in FIG. 2. One side of clevis 78 is pivotally attached to a roller bearing adapter 18. In like manner, a rod 82 is pivotally attached to the roller bearing adapter of the other wheelset. Opposite ends of rods 80 and 82 include resilient bushings 80*a* and 82*a* as a part of each pivotal connection to provide a degree of yaw freedom with respect to the roller bearing adapter and clevis for lateral deflection of the wheelsets.

It is important to note that rods 80 and 82 are pivotally attached to the upper portion or top of the roller bearing adapters, but are atached to the bottom and top of clevis 78. At the opposite end of the torque tube the connections to the clevis will be in the reverse sense. That is, the connection from wheelset 12 will be to the top of the clevis and the connection from wheelset 10 will be to the bottom of the clevis.

Although not shown, damping members, conventionally a small piston and cylinder with attached rods, may be connected between the pivotal connections of the clevis and the pivotal connections with the roller bearing adapters to damp any oscillatory movement brought about during yaw of the wheelsets. The damping members would be useful in preventing truck hunting.

The truck described herein permits constrained relative yaw movement between the wheelsets as would be brought about when the car enters curved track. In like manner, during the period when a car is negotiating a curve, there may be a required lateral deflection of each wheelset relative to the car body to permit the wheels to stay in position upon the rails. When the railroad vehicle enters a curved track, wheelsets 10 and 12 will yaw to assume a radial configuration relative to the radius of curvature of the track. Shear pads 20, which are positioned between the roller bearing adapters and the support pedestals, will permit the degree of yaw necessary to negotiate approximately an eight-degree railroad track curve. As indicated above, there is an-inch-and-a-quarter of space on each side of adapter 18 to accordingly permit yaw movement of that degree between the roller bearing adapter and the supporting pedestal. The wheelsets are connected together and rods 80 and 82 will not interfere with the natural yaw movement of wheelsets having a high effective conicity. When wheelsets of lower conicity are used, the rods will constrain yaw movement of the wheelsets. As wheelsets 10 and 12 move together at the end shown in FIG. 1, rods 80 and 82 will cause torque tube 76 to rotate in a clockwise direction. The opposite ends of the wheelsets would move apart. And since the connections of the corresponding rods are opposite to those illustrated in FIG. 2, this would impart the same clockwise turning movement to torque tube 76. Thus, the torque tube has no torsional movement or stress applied to it during conventional yaw movement. Shear pads 20 will permit a degree of yaw movement consistent with negotiating an approximate eight-degree curve. Once the roller bearing adapter has contacted sides 28 of the pedestal, brought about by yaw movement as described, resistance to further yaw movement will be taken up by the diagonal or upwardly slanted portions of shear pads 52 and wedges 58 which support the car body on the ends of the wheelsets.

In addition to yaw, there are lateral forces applied to the wheelsets during curving which require lateral deflection of the wheelsets relative to the car body. Shear pads 20 again will provide an amount of lateral movement consistent with that required to negotiate an approximate eight-degree curve. If the curve is more severe, the roller bearing adapter ears will contact top member 30 after a predetermined lateral movement. Further efforts at lateral movement by the wheelsets will be accomodated by shear pads 52.

Figure 5:
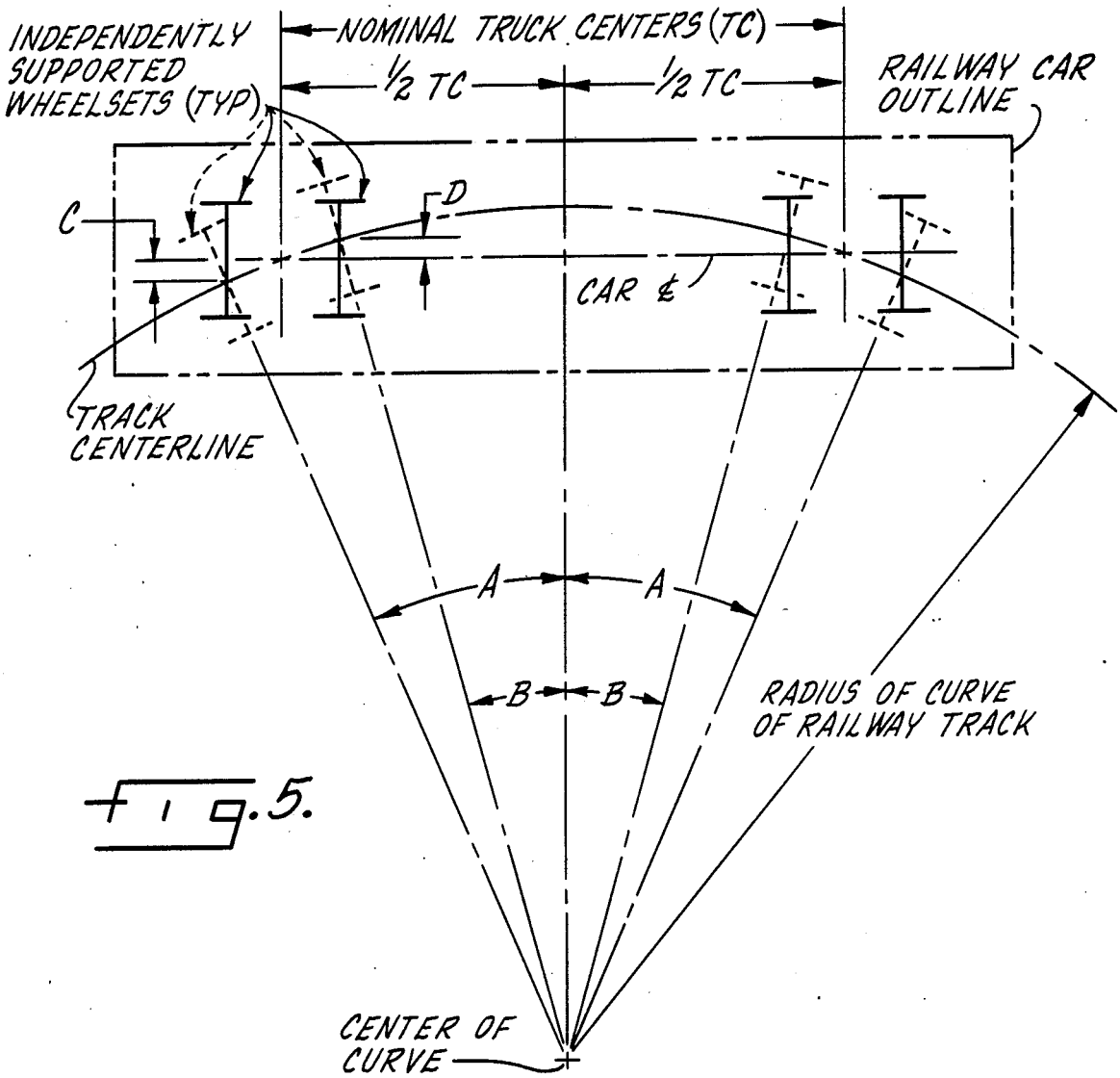
FIG. 5 is a kinematic diagram illustrating independently supported wheelsets on straight (tangent) track and on curved track.

FIG. 5 is a kinematic diagram illustrating the positions of the wheelsets when a car body is on straight track and the change that occurs in the position of the wheelsets when the car body is on curved track. The railway car body is illustrated in outline and the track centerline for curved track is shown in broken line. The independently supported wheelsets are shown in solid line when the car body is on straight track and are shown as dashed lines when the car body is on curved track. The radius of curvature of the railway track is shown, as is the center of the curve. The angle A represents the rotation or angular movement of the outside or end wheelsets with respect to the car body as the car moves from straight track to curved track. The angle B represents the rotation of the inside or inner wheelsets with respect to the car body during the same movement. It should be noted that in all cases the angle A is greater than the angle B, indicating that the wheelsets do not have the same degree of yaw. The distance C represents the lateral displacement of the outside or end wheelsets with respect to the car body and the distance D represents the lateral displacement of the inside wheelsets with respect to the car body. The sum of the distances C and D represents the lateral displacement of the wheelsets with respect to each other.

Because the railroad vehicle described herein has an independent support at each end of each wheelset, the linkage which connects adjacent ends of each wheelset and which, to some degree, constrains the wheelsets to yaw in opposite sense to each other, also permits both wheelsets to yaw in the same direction with respect to the car body as the vehicle negotiates curves. As illustrated in FIG. 5, as a vehicle which has each corner of each wheelset independently suspended moves from straight track to curved track, the wheelsets at each end of the vehicle will yaw in the same sense, but the degree of yaw will not be the same for the leading and trailing wheelsets at each end of each vehicle or car truck. Note that the angle A is greater than the angle B. The degree of yaw for the leading and trailing wheelsets or the outside and inside wheelsets at each end of the vehicle will be different, simply because one wheelset is closer to the center of the car body than the other. Thus, the inner wheelset will rotate through an angle B, whereas, the outer wheelset will rotate through an angle A, and the angle A will always be greater than the angle B. In order to accomodate the different degrees of yaw of wheelsets in the same car truck or vehicle end, the wheelsets are constrained to both yaw in opposite sense with respect to the curve radius intersecting between the wheelsets and therefore with respect to each other in order to align to the center of the curve, and to yaw in the same direction with respect to the vehicle structure. This function is provided by the pivotal connection made up of slot 70*a* and pin 71 which connect the pedestals 24 to bearing housing 70 which in turn supports the opposite ends of the torque tube. The pivotal connection allows for lateral deflection of the pedestal of one wheelset with respect to the other by permitting both rotational and longitudinal movement of one wheelset relative to the other wheelset.

Figure 4:
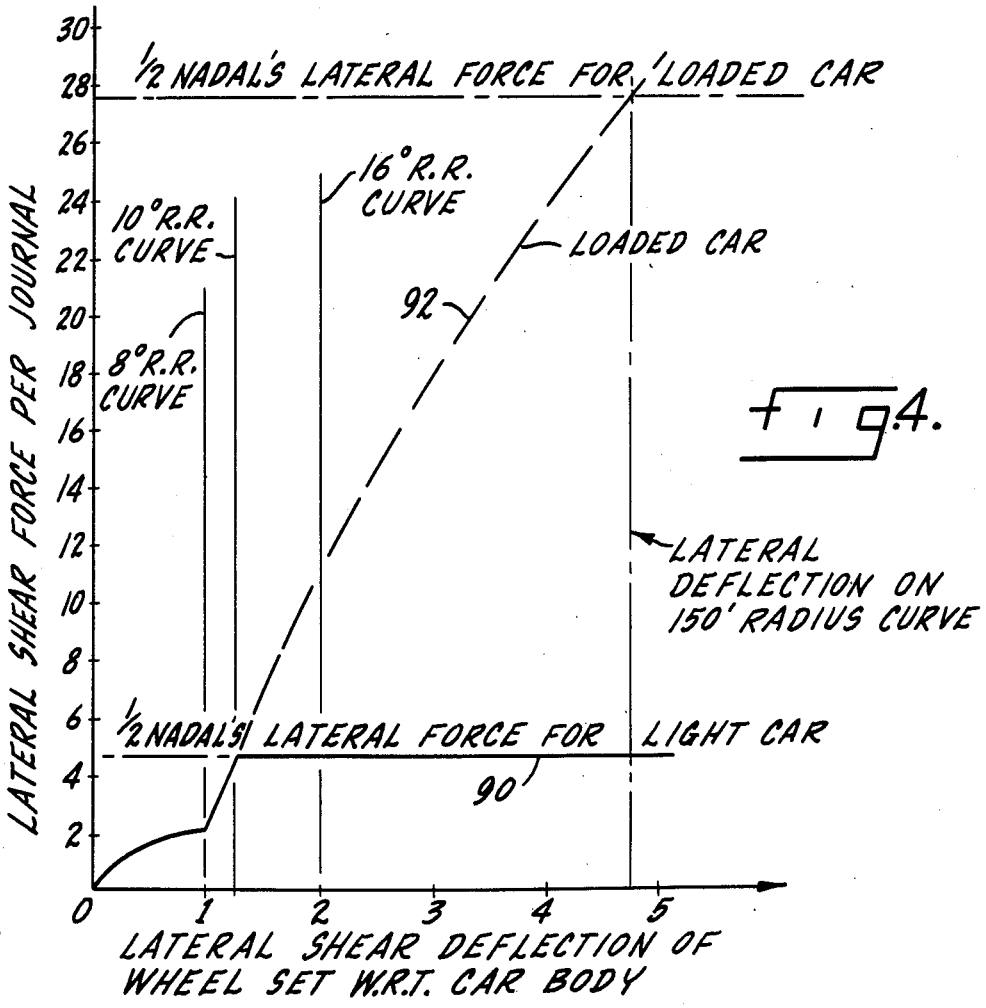
FIG. 4 is a diagram illustrating lateral deflection vs. lateral shear force per wheelset for the railway vehicle disclosed herein.

Referring to FIG. 4, a curve relating lateral shear deflection and the lateral shear force applied per journal or at one end of a wheelset, the American Association of Railroads (AAR) requires that a car negotiate a 150 ft. curve before it can have AAR certification. The AAR also requires traversing a ten-degree curve with 200,000 lbs. of squeeze applied to the car. This is a substantially more severe test than the eight-degree curvature for which the truck is designed and which will accommodate most railroad use. To successfully run through a 150 ft. curve and maintain the wheels on the rails, it is necessary that the wheelsets, with the described permitted yaw, have a lateral shear deflection of $4\frac{3}{4}$ in. with respect to the car body. In a loaded car, the first one inch of such deflection will be accommodated by shear pads 20, as described. The remaining $3\frac{3}{4}$ in. will be accepted by shear pads 52. The two shear pads function in series in that the resistance of a pair of pads 52 does not become effective until the wheelset has moved the permitted deflection of pad 20. The two shear pad constructions, in combination, will permit a lateral wheel set shear deflection of $4\frac{3}{4}$ in. which is required to negotiate the prescribed AAR curve. This is represented by curve 92 of FIG. 4.

A light or unloaded car presents different problems. The first one inch of deflection will again be accommodated by shear pads 20. The next one-fourth inch deflection will be accommodated by shear pads 52. However, further lateral deflection between the wheelset and the car body will be accommodated by movement of the car body wedge pocket relative to the wedge specifically illustrated in FIG. 3. The lateral forces applied by the rails to the wheelsets will cause the wedges 58 to move within pockets 62. As illustrated in FIG. 4, at a predetermined lateral shear force on the unloaded car wheelset the wheelset will deflect the required remaining distance by the described wedge movement. This is illustrated by curve 90.

Wedges 58 and associated pockets 62, the car body shear pads 52 and the wheelsets shear pads 20, individually and in combination, effectively provide for the required 4¾ in. deflection necessary to negotiate the required AAR curve, under all car loading conditions. The specific wedge configuration is also advantageous in that it assists in restoring the car body and wheelset to the original non-deflected position.

The combination of the slope of shear pad portion 56 and the shape of rear wall wedge surface 57 and the slanted configuration of the wedge pocket prevents the wedge from sliding in the car body wedge pocket under loaded car conditions. For example, such might occur if surface 62 of the wedge pocket becomes contaminated with oil or water, a not uncommon condition in a railroad environment. At loaded car conditions, shear pad 52 will have a preload deflection appromimately one-half inch, which will cause a predetermined normal force between the slope shear pad and the facing wedge surface. This force will prevent vertical movement between the wedge and the pocket, which in turn will prevent lateral movement between the wedge and pocket at loaded car conditions. At light or unloaded car conditions the sloped or slanted surfaces 62 of the two wedge pockets are spaced in the longitudinal direction such that there is no preload between the wedge and the pocket.

In order to successfully negotiate the required AAR curve, if cross anchors or cross rods were used to connect opposite ends of the wheelsets, as is conventional in radial trucks, it would be necessary to have in the area of six inches of yaw movement at each wheelset. It is impossible to accommodate yaw movement of that degree. Accordingly, the required movement of the wheelset to negotiate the curve is largely taken up by the lateral movement described above. There is still yaw movement; however, it is on the order of the one-and-one-quarter inch of permitted movement described. Because the wheelsets are moving in a lateral direction, the torque tube must be mounted in a pillow block which will permit the torque tube to pivot relative to its mounting. In like manner, housing 70 for opposite ends of the torque tube must be able to pivotally move relative to the wheelset supports to permit the required lateral and yaw movements necessary to move the truck around curves.

Both lateral and yaw movements are required in negotiating curves and the support system for the vehicle permits such movement. The wheelsets are constrained against relatively longitudinal movement, either toward or away from each other, both by the housings 70 and by the torque tube. If the wheelsets are urged longitudinally apart, this movement will be resisted by the torque tube because of the manner in which the rods 80 and 82 are connected to opposite ends of the torque tube. Similarly, loads applied to the support pedestals 24 which might tend to move one of the shear pads out of engagement with the car body support will be resisted by the torque tube supports 70.

When railroad vehicles of the type described are used on unit trains which function with automatic dumpers, a squeezing movement is applied to the truck wheelsets during the dumping operation. Rods 80 and 82 connected, as described, to torque rod 76, not only will accommodate yaw and lateral movements, as described, but are sufficient to resist this substantial squeezing movement. When the truck wheelsets are being held in an automatic dumper locking device, large longitudinal forces are applied to the car body by the forces applied to the train. These forces are transmitted to the locking device through the truck system. In this design, such forces would tend to rotate the pedestal assemblies about roller bearing 16. Such loads applied to the support pedestals which might otherwise tend to move a shear pad out of engagement with the car body support will be resisted by torque tube supports 70.

In a conventional rigid three-piece car truck, hunting is manifested by a pivoting of the entire rigid truck about the center pivot point of connection to the freight car body. In a self-steering truck, without connections between wheelsets, hunting is brought about by oscillation of the individual wheelsets. In a radial frameless car truck system where there is a low yaw constraint between the wheelsets and the frame for curving, hunting stability is acquired by the interconnection of the wheelsets such that they are forced to yaw in an opposite sense with respect to each other. This interconnection between wheelsets must have a predetermined minimum stiffness and, as shown herein, the predetermined minimum stiffness required is the connection between the roller bearing adapter and clevis 78. The stiffness may be provided by the rod, such as rod 80 or 82, which forms the connection, or as is preferred, by the bushing mounted upon the clevis which is a part of the connection. The stiffness of the connection or the spring rate of the material of the bushing must be a predetermined minimum and when the stiffness is below such predetermined minimum, the speed at which hunting occurs drops off dramatically. Similarly, the stiffness cannot be too great or again the speed at which hunting occurs will drop off dramatically. It is preferred that the stiffness of the connection or the resiliency of the connection be provided by the bushing forming a part of the connection rather than the rod, so that the stiffness of the rod alone, after the resiliency permitted by the bushing has bottomed out, can be used in car braking. For example, the combined effective stiffness provided by the resilient bushings at each end of the rod should be not less than 40,000 lbs. per inch to provide good truck hunting stability at unloaded car conditions.

Whereas the preferred form of the invention has been shown and described herein, it should be realized that there may be many modifications, substitutions and alterations thereto.

The embodiments of the invention in which an exclusive property or privilege is claimed are defined as follows:

1. A frameless self-steering radial wheeled support vehicle for a railroad car body including:

(a) a pair of wheelsets, (b) a support at opposite ends of each wheelset for independently mounting a car body on each end of the wheelset, (c) resilient means for mounting each support upon an end of a wheelset, which resilient means permits both lateral and yaw movement of a wheelset relative to its supports, and (d) a linkage connecting adjacent ends of each wheelset and constraining the wheelsets to yaw in opposite sense and permitting lateral movement of one wheelset relative to the other, said linkage including a yaw connection between adjacent ends of each wheelset and across vehicle connection between yaw connections.

2. The vehicle of claim 1 further characterized in that each support includes support resilient means permitting lateral movement of a wheelset relative to the car body.

3. The vehicle of claim 2 further characterized in that said support resilient means includes elastomeric pads positioned on opposite sides of a wheelset axle at each end of a wheelset, said pads each having a generally horizontal portion and an upwardly-extending portion.

4. The vehicle of claim 2 further characterized in that each support includes a pedestal, spring means mounted upon each pedestal, with said support resilient means being mounted upon said spring means.

5. The vehicle of claim 4 further characterized in that said pedestal is mounted upon said first-named resilient means, said spring means being positioned upon opposite sides of a wheelset axle.

6. The vehicle of claim 4 further characterized by and including damping means mounted upon each pedestal to restrain relative vertical movement between each pedestal and the car body.

7. The vehicle of claim 1 further characterized in that said resilient means for mounting each support include an elastomeric material providing an amount of damping not less than ten percent of critical damping.

8. The vehicle of claim 1 further characterized in that each of said supports includes a pedestal extending on opposite sides of each wheelset axle, there being a pedestal at each end of each wheelset, each wheelset including a roller bearing positioned at each end thereof and a roller bearing adapter mounted on each roller bearing, said resilient means positioning each pedestal upon its associated roller bearing adapter.

9. The vehicle of claim 8 further characterized in that said resilient means includes an elastomeric material providing an amount of damping not less than ten percent of critical damping.

10. The vehicle of claim 8 further characterized in that said linkage pivotally connects adjacent portions of pedestals at adjacent ends of the wheelsets.

11. The vehicle of claim 8 further characterized in that the resilient means positioning each pedestal upon a roller bearing adapter permits relative movement therebetween in both lateral and yaw directions of a predetermined amount.

12. The vehicle of claim 1 further characterized in that said cross connection includes a torsion member connected between said yaw connections to rotate during yaw movement of the wheelsets and to torsionally resist longitudinal relative movement of the wheelsets.

13. The vehicle of claim 12 further characterized by and including roller bearing adapter means mounted on the end of each wheelset, said yaw connections each include a pair of rods, each rod being pivotally connected to a roller bearing adapter means and the rods in each pair being pivotally connected together at opposite ends of said torsion member.

14. The vehicle of claim 13 further characterized in that the pivotal connections at opposite ends of each rod include means permitting yaw movement between each roller bearing adapter means and said torsion member.

15. The vehicle of claim 13 further characterized in that opposite ends of said torsion member are pivotally mounted on platform members, each platform member being pivotally connected, at opposite ends thereof, to a wheelset support.

16. The vehicle of claim 15 further characterized in that each pivotal connection between a platform member and its associated wheelset supports permits relative rotational and longitudinal movement between each platform member and its associated wheelset supports.

17. A frameless self-steering radial wheeled support vehicle for a railroad car body including:

(a) a pair of wheelsets, (b) a support at opposite ends of each wheelset for independently mounting a car body on each end of the wheelset, (c) resilient means for mounting each support upon an end of a wheelset, which resilient means permits yaw movement of a wheelset relative to its supports, and (d) a linkage connecting adjacent ends of each wheelset and constraining the wheelsets to yaw in opposite sense relative to each other, said linkage further permitting both wheelsets to yaw in the same direction with respect to the car body.

18. The vehicle of claim 17 further characterized in that said linkage includes a yaw connection between adjacent ends of each wheelset and a cross vehicle connection between yaw connections.

19. The vehicle of claim 18 further characterized in that said cross connection includes a torsion member connected between said yaw connections to rotate during yaw movement of the wheelsets and to torsionally resist longitudinal relative movement of the wheelsets.

20. The vehicle of claim 19 further characterized by and including roller bearing adapter means mounted on the end of each wheelset, said yaw connections each include a pair of rods, each rod being pivotally connected to a roller bearing adapter means and the rods in each pair being pivotally connected together at opposite ends of said torsion member.

21. The vehicle of claim 20 further characterized in that opposite ends of said torsion member are pivotally mounted on platform members, each platform member being pivotally connected, at opposite ends thereof, to a wheelset support.

22. A frameless self-steering radial wheeled support vehicle for a railroad car body including:

(a) a pair of wheelsets, (b) a support at opposite ends of each wheelset for independently mounting a car body on each end of the wheelset, said support including frictional resistance means providing for restrained lateral movement between said support and the car body, and (c) resilient means for mounting each support upon an end of a wheelset, which resilient means permits lateral movement of a wheelset relative to its supports.

23. The vehicle of claim 22 further characterized in that each support includes support resilient means permitting lateral movement of a wheelset relative to the car body.

24. The vehicle of claim 23 further characterized in that said support resilient means includes elastomeric pads positioned on opposite sides of a wheelset axle at each end of a wheelset, said pads each having a generally horizontal portion and an upwardly-extending portion.

25. The vehicle of claim 23 further characterized in that each support includes a pedestal, spring means mounted upon each pedestal, with said support resilient means being mounted upon said spring means.

26. The vehicle of claim 25 further characterized in that said pedestal is mounted upon said first-named resilient means, said spring means being positioned upon opposite sides of a wheelset axle.

27. The vehicle of claim 25 further characterized by and including damping means mounted upon each pedestal to restrain relative vertical movement between each pedestal and the car body.

28. The vehicle of claim 27 further characterized in that said damping means includes a friction wedge mounted upon each pedestal, a frame positioned upon said spring means and in contact with said friction wedge, said friction wedge greatly restricting longitudinal movement of said pedestal with respect to said frame and the car body.

29. The vehicle of claim 22 further characterized in that each support includes support resilient means permitting lateral movement of a wheelset relative to the car body, said frictional resistance means being mounted upon said support resilient means.

30. The vehicle of claim 29 further characterized by and including spring means forming a part of each support and in turn mounting each of said support resilient means.

31. The vehicle of claim 29 further characterized in that said frictional resistance means and said support resilient act together to greatly restrict longitudinal movement of said support while permitting lateral movement of the said support relative to the car body.

32. The vehicle of claim 22 further characterized in that each of said frictional resistance means includes a wedge-shaped pocket on the underside of the car body and a wedge-shaped member extending into the pocket and forming a portion of each support.

33. A frameless self-steering radial wheeled support vehicle for a railroad car body including:

(a) a pair of wheelsets, (b) a support at opposite ends of each wheelset for independently mounting a car body on each end of the wheelset, each support including frictional resistance means providing for restrained lateral movement between said support and the car body, and (c) resilient means for mounting each support upon an end of a wheelset, which resilient means permits both lateral and yaw movement of a wheelset relative to its supports.

34. The vehicle of claim 33 further characterized in that each of said frictional resistance means includes a wedge-shaped pocket on the underside of the car body and a wedge-shaped member extending into the pocket and forming a portion of each support.

35. The vehicle of claim 33 further characterized in that each support includes support resilient means permitting lateral movement of a wheelset relative to the car body, said frictional resistance means being mounted upon said support resilient means.

36. The vehicle of claim 35 further characterized in that said support resilient means includes a generally horizontal elastomeric pad portion and a slanted elastomeric pad portion.

37. The vehicle of claim 36 further characterized in that said frictional resistance means includes a wedge-shaped pocket on the underside of the car body and a wedge-shaped member extending into said pocket and mounted upon said generally horizontal and slanted elastomeric pad portions.

38. The vehicle of claim 37 further characterized in that each of said wedge-shaped members has a slanted surface away from said slanted elastomeric pad portion and generally parallel thereto which is in engagement with said wedge-shaped pocket.

39. The vehicle of claim 35 further characterized by and including spring means forming a part of each support and in turn mounting each of said support resilient means.

40. A frameless self-steering radial wheeled support vehicle for a railroad car body including:

(a) a pair of wheelsets, (b) a support at opposite ends of each wheelset for independently mounting a car body on each end of the wheelset, (c) resilient means for mounting each support upon an end of a wheelset, which resilient means permits both lateral and yaw movement of a wheelset relative to its supports, and (d) a linkage connecting adjacent ends of each wheelset and constraining the wheelsets to yaw in opposite sense, permitting both wheelsets to yaw in the same direction with respect to the car body, and permitting lateral movement of one wheelset relative to the other.

41. The vehicle of claim 40 further characterized in that each linkage includes a pivotal connection between adjacent ends of each wheelset.

42. The vehicle of claim 41 further characterized in that each linkage includes a platform member intermediate the adjacent ends of each wheelset and pivotally connected, at opposite ends thereof, to a wheelset support.

43. The vehicle of claim 42 further characterized in that each such pivotal connection between a platform member and its associated wheelset supports permits relative rotational and longitudinal movement between each platform member and its associated wheelset supports.

44. The vehicle of claim 43 further characterized by and including a cross vehicle connection between each linkage, with said cross vehicle connection being supported by said platform members.

* * * * *